US012410598B2

(12) United States Patent
Ningappa et al.

(10) Patent No.: US 12,410,598 B2
(45) Date of Patent: Sep. 9, 2025

(54) TOILET ARRANGEMENT FOR SWIRL FLUSHING

(71) Applicant: Kohler India Corporation Pvt. Ltd., New Delhi (IN)

(72) Inventors: Mohan Ningappa, New Delhi (IN); Chandra Lohia, New Delhi (IN); Ramesh Narkhede, New Delhi (IN); Saber Shaikh, New Delhi (IN); Anshuman Gupta, New Delhi (IN); Atul Dhiman, New Delhi (IN)

(73) Assignee: Kohler India Corporation Private Limited, New Delhi (IN)

( * ) Notice: Subject to any disclaimer, the term of this patent is extended or adjusted under 35 U.S.C. 154(b) by 342 days.

(21) Appl. No.: 18/098,830

(22) Filed: Jan. 19, 2023

(65) Prior Publication Data

US 2023/0235543 A1 Jul. 27, 2023

(30) Foreign Application Priority Data

Jan. 27, 2022 (IN) ..... 202211004621

(51) Int. Cl.
*E03D 11/08* (2006.01)

(52) U.S. Cl.
CPC ..... *E03D 11/08* (2013.01)

(58) Field of Classification Search
CPC ..... E03D 11/08
USPC ..... 4/420, 421, 430
See application file for complete search history.

(56) References Cited

U.S. PATENT DOCUMENTS 2,050,152 A * 8/1936 Beam ..... E03D 11/08 4/421
2,993,213 A * 7/1961 Carroll ..... A47K 3/02 4/591
4,710,987 A * 12/1987 Mesun ..... E03D 11/00 4/420

* cited by examiner

*Primary Examiner* — Tuan N Nguyen
(74) *Attorney, Agent, or Firm* — Lempia Summerfield Katz LLC

(57) ABSTRACT

A toilet bowl of a toilet, the toilet bowl comprising: a toilet base bowl comprising an upper portion and a toilet rim disposed in the upper portion of the toilet base bowl. The toilet rim comprises a tubular structure comprising a first end configured to receive water, a second end, and a middle section disposed between the first end and the second end. The water is configured to flow in a water flow direction towards the second end, and the second end is closed. The toilet rim also comprises a plurality of outlet conduits extending from the middle section directed towards an interior of the toilet base bowl. The plurality of outlet conduits is directed at an acute angle relative to the water flow direction, such that plurality of outlet conduits allow the water to enter the interior of the toilet base bowl in a swirl-flow manner.

18 Claims, 7 Drawing Sheets

TOILET ARRANGEMENT FOR SWIRL FLUSHING

CROSS REFERENCE TO RELATED APPLICATION

This application claims the benefit of priority to: Indian Patent Application No. 202211004621 filed in the Indian Intellectual Property Office on Jan. 27, 2022, which is hereby incorporated by reference in its entirety.

FIELD

The present disclosure relates to a toilet bowl of a toilet arrangement. More particularly, the present disclosure relates to a toilet rim for the toilet bowl of the toilet arrangement.

BACKGROUND

This section is intended to provide information relating to the field of the present disclosure and thus any approach or functionality described below should not be assumed to be qualified as prior art merely by its inclusion in this section.

Toilet arrangements are known in sanitation industry, to enable persons to defecate in good sanitary conditions. A typical toilet arrangement includes a toilet bowl (also referred to as a 'water closet', interchangeably hereinafter) and a flush arrangement. The toilet bowl is provided to receive faecal (fecal) matter, when a user performs defecation thereon. The flush arrangement includes a flush tank and a flush valve unit. The flush tank stores water therein. The flush valve unit is fluidly connected between the flush tank and the toilet bowl, to allow/restrict a supply of water from the flush tank to the toilet bowl, upon actuation/release of at least one flush button. This results in flushing of faecal matter therefrom.

The toilet bowl includes a toilet base bowl and a toilet rim. The toilet base bowl is formed of ceramic material, including a lower portion and an upper portion. The lower portion is shaped in form of a bowl, while the upper portion is shaped in form of an oval-shaped peripheral structure, which support the person while defaecating. Further, the toilet rim is arranged within the upper portion of the toilet base bowl, such that the toilet rim receives water from the flush tank and distributes the same in the toilet base bowl, for flushing.

The toilet rim includes an oval-shaped closed loop tubular structure and a plurality of outlet conduits extending perpendicularly downwards from the oval-shaped closed loop tubular structure towards the toilet base bowl. Further, the oval-shaped closed loop tubular structure is fluidly connected to the flush arrangement, to receive water therefrom. In particular, the oval-shaped closed loop tubular structure includes a T-joint fluidly connected with a supply pipe extending from the flush arrangement. Accordingly, water, as received from the flush arrangement, is divided in two streams of water in the oval-shaped closed loop tubular structure, which is released through the plurality of outlet conduits to the toilet bowl. This reduces a water pressure released from the toilet rim to the toilet base bowl and thus requires more water to perform flushing. Further, in toilet rims, the plurality of outlet conduits extend perpendicularly downwards from the oval-shaped closed loop tubular structure. This results in release of water from the toilet rim to the toilet base bowl in a relatively turbulent manner, which may further cause requirement of relatively more water to perform flushing. Also, a flow velocity of water in the oval-shaped closed loop tubular structure reduces drastically between the T-joint and the point of meeting of the two streams of water, in particular, a flow velocity of water at a position in proximity of the T-joint is more than a flow velocity of water at a position of meeting of the two streams of water. This results in loss of potential energy of water and thus requires more water for flushing.

Accordingly, in light of the aforementioned drawbacks and several other inherent in the arts, there is a well felt need to provide a toilet bowl of a toilet arrangement that uses relatively less water for flushing purposes.

SUMMARY

This section is intended to introduce certain objects of the disclosed method and system in a simplified form and is not intended to identify the key advantages or features of the present disclosure.

It is an object of the present disclosure to provide a toilet bowl of a toilet arrangement. The toilet bowl comprises a toilet base bowl and a toilet rim. The toilet rim is arranged with an upper portion of the toilet base bowl and comprises a tubular structure and a plurality of outlet conduits. The tubular structure defines a first end, a second end, and a middle section defined therebetween. The tubular structure is configured to receive water through the first end, to be flown in a water flow direction towards the second end, while the second end is closed. The plurality of outlet conduits extends from the middle section directed towards an interior of the toilet base bowl, the plurality of outlet conduits being angled at an acute angle relative to the water flow direction, such that a plurality of outlet conduits allow exit of water to an interior of the toilet base bowl, in a swirl-flow manner.

BRIEF DESCRIPTION OF THE FIGURES

The present disclosure, both as to its organization and manner of operation, together with further objects and advantages, may be understood by reference to the following description, taken in connection with the accompanying drawings. These and other details of the present disclosure will be described in connection with the accompanying drawings, which are furnished only by way of illustration and not in limitation of the present disclosure, and in which drawings.

DETAILED DESCRIPTION

Figure 1:
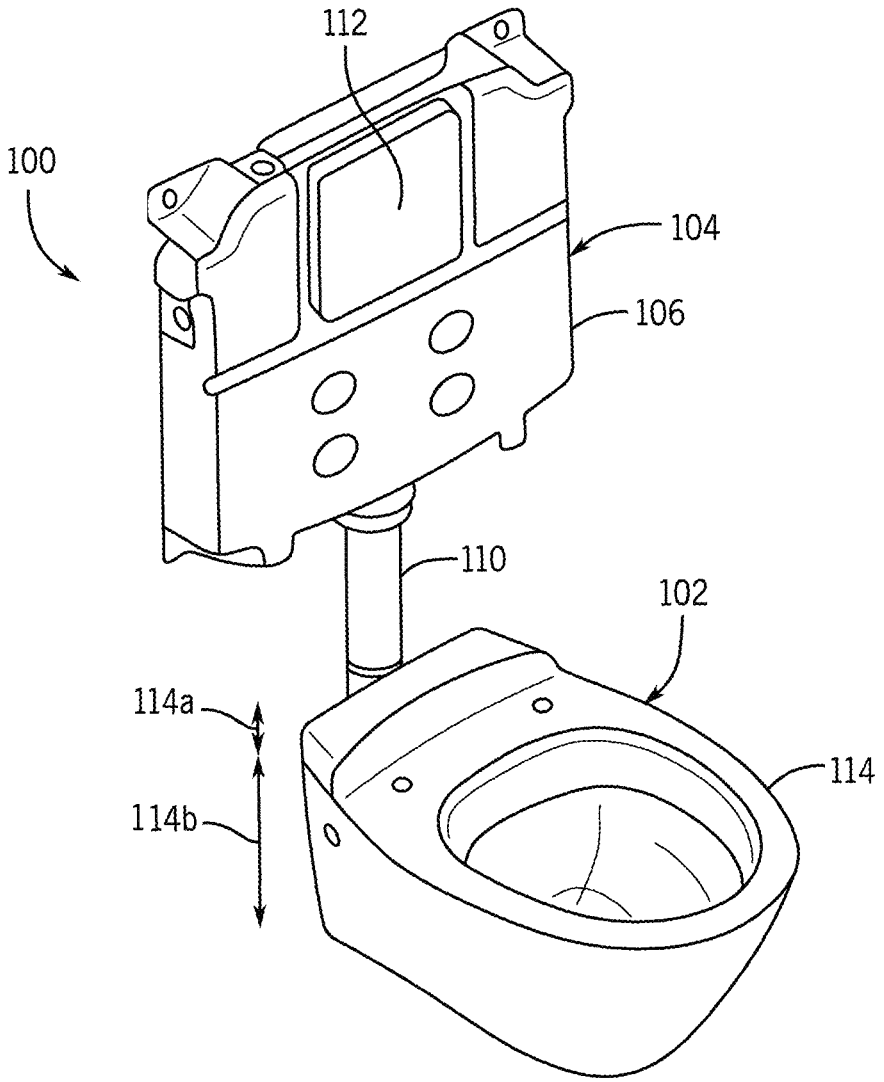
FIG. 1 is a perspective view of a toilet arrangement, in accordance with the concepts of the present disclosure.

In the following description, for the purposes of explanation, various specific details are set forth in order to provide a thorough understanding of embodiments of the present disclosure. It should be apparent, however, that embodiments of the present disclosure may be practiced without these specific details. Several features described hereafter can each be used independently of one another or with any combination of other features. An individual feature may not address any of the problems discussed above or might address only one of the problems discussed above. Some of the problems discussed above might not be fully addressed by any of the features described herein. Example embodiments of the present disclosure are described below, as illustrated in various drawings in which like reference numerals refer to the same parts throughout the different drawings.

FIG. 1 shows a perspective view of a toilet arrangement 100, in accordance with the concepts of the present disclosure. The toilet arrangement 100 facilitates a person to defecate in good sanitary conditions. The toilet arrangement 100 (e.g., a toilet) is generally known to include a toilet bowl 102 and a flush arrangement 104.

The toilet bowl 102 is a bowl structure, which is provided to receive faecal matter, when a user performs defecation thereon. Details of structure and arrangement of the toilet bowl 102 are explained below in details.

The flush arrangement 104 is provided to supply water to the toilet bowl 102, for flushing faecal matter therefrom. The flush arrangement 104 includes a flush tank 106 and a flush valve unit. The flush tank 106 is configured to store water therein. Further, the flush tank 106 of the flush arrangement 104 is fluidly connected to the toilet bowl 102 with use of a supply pipe 110. The flush valve unit is positioned within the supply pipe 110 and is configured to allow/restrict the supply of water from the flush tank 106 of the flush arrangement 104 to the toilet bowl 102. In particular, the flush valve unit allows/restrict the supply of water from the flush tank 106 of the flush arrangement 104 to the toilet bowl 102, upon actuation/release of at least one flush button 112. Flushing is enabled in the toilet bowl 102, corresponding to the supply of water from the flush tank 106 of the flush arrangement 104 to the toilet bowl 102. Although, the present disclosure describes the toilet arrangement 100 as a tank-based toilet arrangement, it may be apparent to a person having ordinary skill in the art that the toilet arrangement can also be an in-line toilet arrangement. A structure and an arrangement of the toilet bowl 102 are explained in detail hereinafter.

Figure 2:
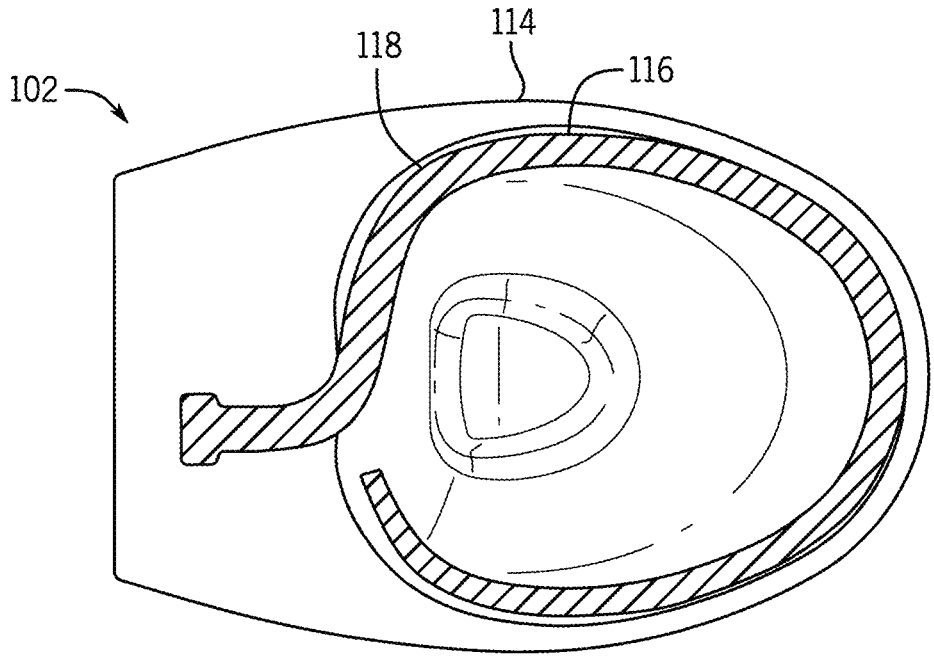
FIG. 2 is a top view of a toilet bowl of the toilet arrangement of FIG. 1, in accordance with the concepts of the present disclosure.

FIG. 1 shows a perspective view of a toilet arrangement 100, in accordance with the concept of the present disclosure. FIG. 2 shows a top view of the toilet bowl 102 of the toilet arrangement 100, in accordance with the concepts of the present disclosure. FIG. 1 and FIG. 2 should be referred to in conjunction with each other in order to clearly understand the concepts of the present disclosure related to the toilet bowl 102. The toilet bowl 102 includes a toilet base bowl 114 and a toilet rim 116. In a second example of the toilet bowl 102, each of the toilet base bowl 114 and the toilet rim 116 is formed as a separate component and further connected together to form the toilet bowl 102. In a first example of the toilet bowl 102, each of the toilet base bowl 114 and the toilet rim 116 is integrally formed as a singular integrated component. Both the embodiments are within a scope of the present disclosure.

Concept in respect of the first example of the toilet bowl 102 is explained hereinafter. In the first example of the toilet bowl 102, the toilet base bowl 114 and the toilet rim 116 are integrally formed. In the first example, each of the toilet base bowl 114 and the toilet rim 116 are formed of ceramic material. In such embodiment, the toilet base bowl 114 and the toilet rim 116 are formed by casting in a single casting machine. The toilet base bowl 114 includes a lower portion 114*b* and an upper portion 114*a*. The toilet rim 116 is arranged with the upper portion 114*a* of the toilet base bowl 114 and is configured to distribute water as received from the flushing arrangement 104, within the toilet base bowl 114, for enabling flushing of faecal matter therefrom.

Figure 3:
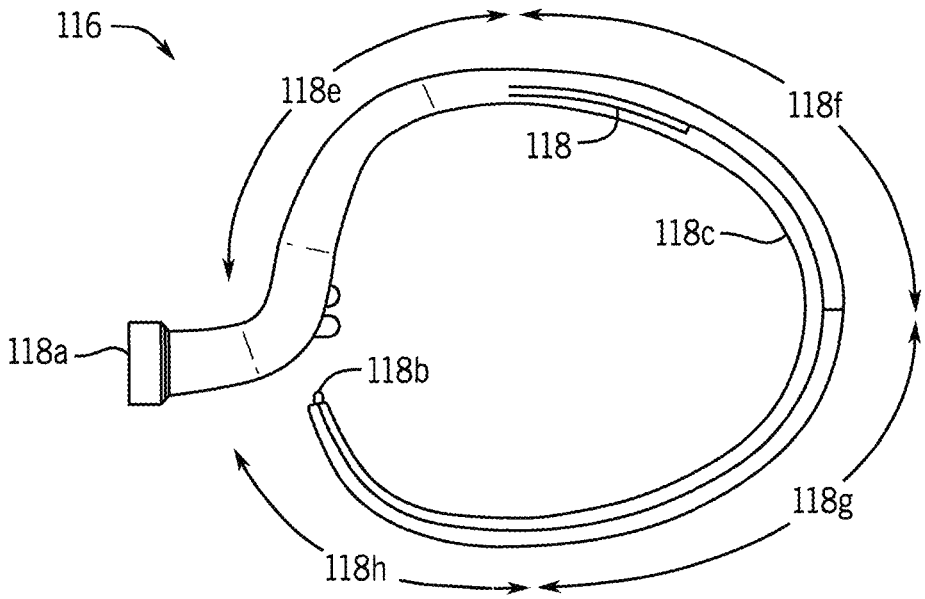
FIG. 3 is a top view of a toilet rim of the toilet bowl of FIG. 2, in accordance with a first example of the present disclosure.
Figure 4:
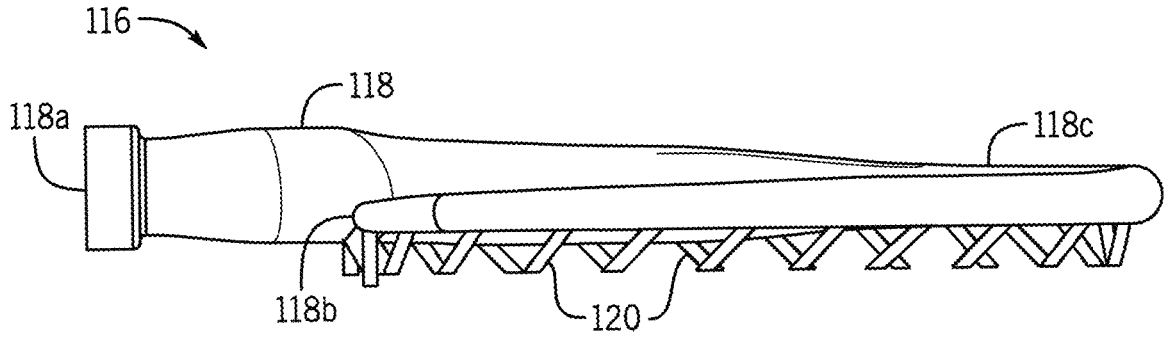
FIG. 4 is a side view of the toilet rim of the toilet bowl of FIG. 2, in accordance with the first example of the present disclosure.

FIG. 3 is a top view of the toilet rim 116 of the toilet bowl 102, in accordance with the concepts of the first example of the toilet bowl 102 disclosed in the present disclosure. FIG. 4 is a side view of the toilet rim 116 of the toilet bowl 102, in accordance with the concepts of the first example of the toilet bowl 102 disclosed in the present disclosure. FIG. 3 and FIG. 4 should be referred to, in conjunction with each other, in order to clearly understand concepts of the present disclosure with respect to the first example of the toilet rim 116. Although, FIG. 3 and FIG. 4, for illustrative purposes, show the toilet rim 116 as a separate component, it may be apparent to a person having ordinary skill in the art that the toilet rim 116 may be the integral component of the toilet bowl 102, in accordance with the first example of the toilet bowl 102. In particular, the toilet rim 116 includes a tubular structure 118 and a plurality of outlet conduits 120.

The tubular structure 118 is provided in form of a singular tubular structure, suitably bent to form an oval-structured unit, in particular an open-looped oval-structure unit, conforming to the upper portion of the toilet base bowl 114. Although, the present disclosure is explained as the tubular structure 118 being deployed as the open-looped oval-structure unit, it may be apparent to a person having ordinary skill in the art that the tubular structure 118 can also be deployed as an open-looped square structured unit and/or an open-looped circular structured unit, depending on a shape of the upper portion 114*a* of the toilet base bowl 114. The tubular structure 118 defines or comprises a first end 118*a*, a second end 118*b*, and a middle section 118*c* defined therebetween. The first end 118*a* of the tubular structure 118 is fluidly connected to the supply pipe 110 of the flushing arrangement 104, to receive water therefrom. Further, the second end 118*b* of the tubular structure 118 is closed. With such an arrangement, the tubular structure 118 is configured to receive water through the first end 118*a*, to be flown in a water flow direction towards the second end 118*b* through the middle section 118*c*. Furthermore, the tubular structure 118 is sequentially divided into four sections, namely a first section 118*e*, a second section 118*f*, a third section 118*g*, and a fourth section 118*h*, in the water flow direction. The first section 118*e* includes the first end 118*a*, and the fourth section 118*h* includes the second end 118*b*. An interior of the tubular structure 118 has a cross-section area that decreases continuously from the first end 118*a* to the second end 118*b* in the water flow direction. The interior of at least one portion of the tubular structure 118 has an elliptical cross-section area. This allows a smooth and laminar flow of water within the tubular structure 118, while flowing from the first end 118*a* to the second end 118*b* in the water flow direction. In particular, the cross-sectional area of the at an end of the first section 118*e* in the water flow direction is 50% of a cross-section area at the first end 118*a* defined by the first section 118*e* of the tubular structure 118. Moreover, a cross-section area at an end of the second section 118*f* in the water flow direction is 36% of the cross-section area at the first end 118*a* defined by the first section 118*e* of the tubular structure 118. Moreover, a cross-section area at an end of the third section 118*g* in the water flow direction is 25% of the cross-section area of the first end 118*a* defined by the first section 118*e* of the tubular structure 118. Furthermore, a cross-section area at the second end 118*b* defined by the fourth section 118*h* of the tubular structure in the water flow direction is 9.5% of the cross-section area of the first end 118*a* defined by the first section 118*e* of the tubular structure 118. It may also be noted that the cross-section of the tubular structure 118 decreases continuously from the first end 118*a* to the second end 118*b*, in particular, the cross-section of the tubular structure 118 decreases continuously between the first section 118*e*, the second section 118*f*, the third section 118*g*, and the fourth section 118*h*. This results in positioning of the first end 118*a* of the tubular structure 118 at a relatively higher height than the second end 118*b* of the tubular structure 118.

The plurality of outlet conduits 120 are configured to release water received in the tubular structure 118 to the toilet base bowl 114, for flushing. The plurality of outlet conduits 120 are relatively small conduit pipes extending from the middle section 118*c* directed towards an interior of the toilet base bowl 114. The plurality of outlet conduits 120 are angled or directed at an acute angle relative to the water flow direction. As the plurality of outlet conduits 120 are angled at an acute angle, the plurality of outlet conduits 120 allow exit of water to an interior of the toilet base bowl 114, in a swirl-flow manner Such exit of water to the interior of the toilet base bowl 114 in the swirl-flow manner requires relatively less water for flushing the faecal matter from the toilet base bowl 114.

Figure 5:
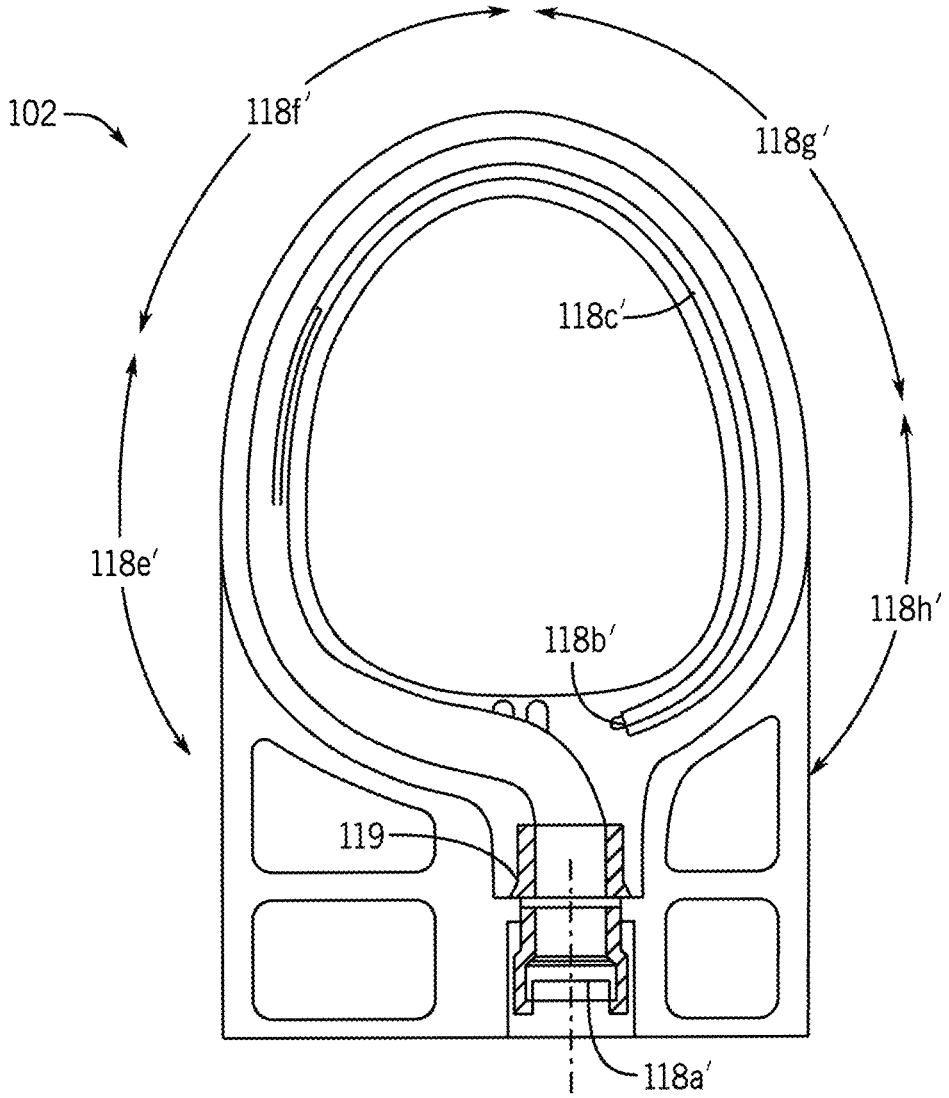
FIG. 5 is a top view of the toilet rim of the toilet bowl, in accordance with the concepts of a second example of the toilet bowl disclosed in the present disclosure.
Figure 6:
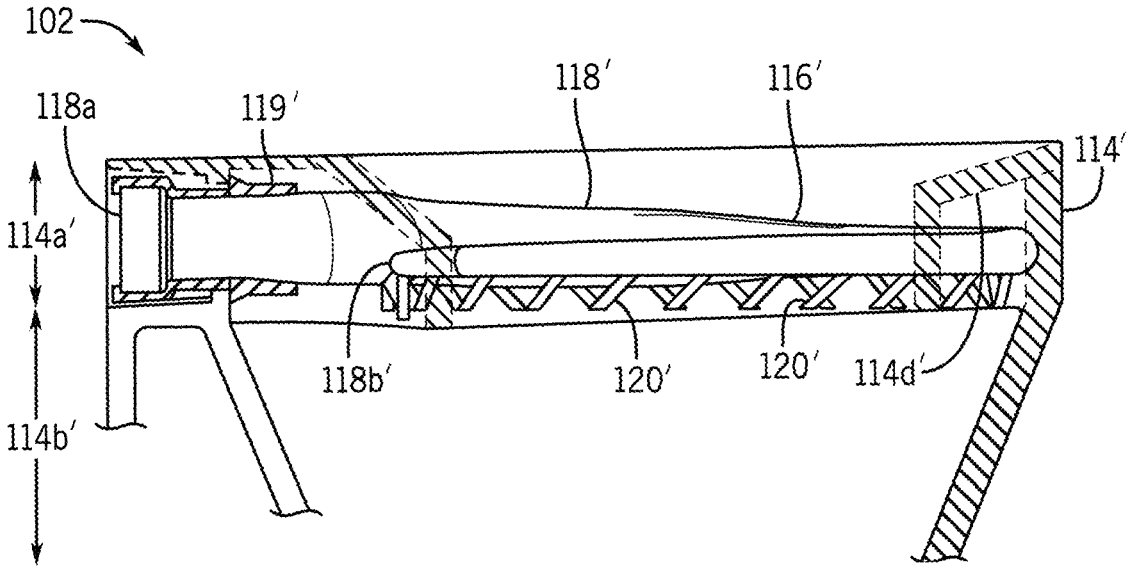
FIG. 6 is a side view of the toilet rim of the toilet bowl, in accordance with the concepts of the second example of the toilet bowl disclosed in the present disclosure.
Figure 7:
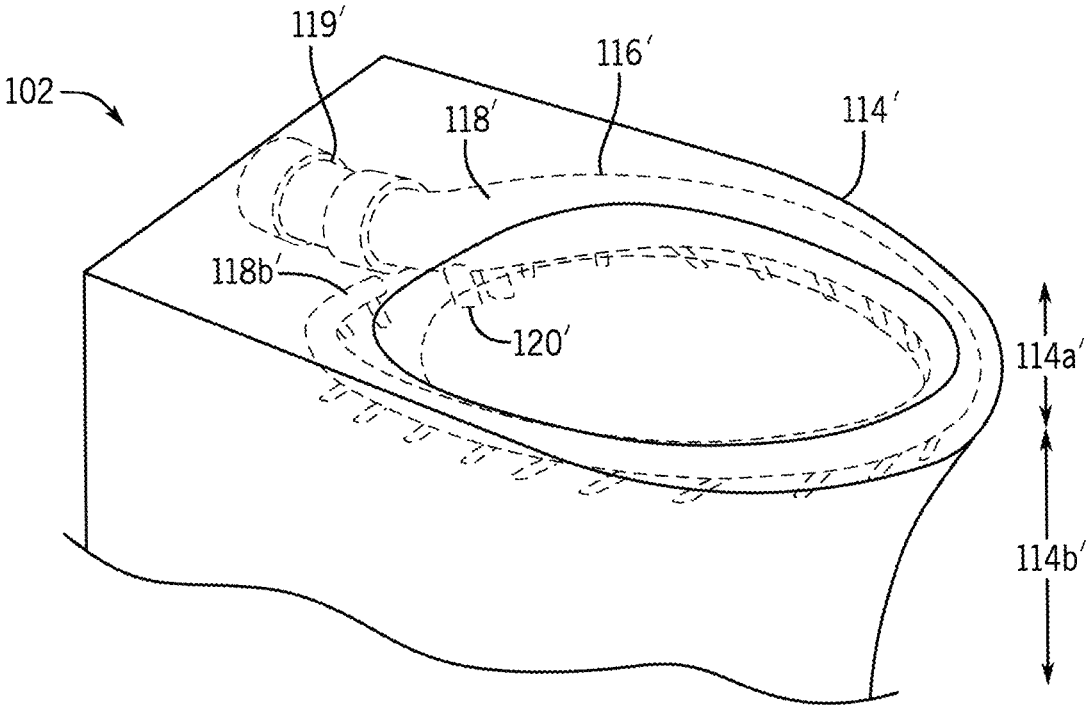
FIG. 7 is a schematic of a section of a portion of the toilet bowl of FIG. 2, in accordance with the second example of the present disclosure.

Concepts in accordance with the second example of the toilet bowl 102, will be explained in detail hereinafter. FIG. 5 is a top view of a schematic of the toilet bowl 102, in accordance with the concepts of the second example of the toilet bowl 102 disclosed in the present disclosure. FIG. 6 is a side view of a schematic of the toilet bowl 102, in accordance with the concepts of the second example of the toilet bowl 102 disclosed in the present disclosure. FIG. 7 shows an isometric view of a portion of a schematic of the toilet bowl 102, in accordance with the second example of the toilet bowl 102. FIG. 5, FIG. 6, and FIG. 7, should be referred to in conjunction with each other, in order to clearly understand the concepts of the second example of the toilet bowl 102 disclosed in the present disclosure. In the second example of the toilet bowl 102, the toilet base bowl 114' and the toilet rim 116' are separately formed. In the second example of the toilet bowl 102, the toilet base bowl 114' is formed of a ceramic material, while the toilet rim 116' is at least partially formed of an elastomer material.

A structure and an arrangement of the toilet base bowl 114' in accordance with the second example of the toilet bowl 102 are similar to a structure and arrangement of the toilet base bowl 114' in accordance with the first example of the toilet bowl 102. Particularly, the toilet base bowl 114' includes a lower portion 114*b'* and an upper portion 114*a'*. In one embodiment, the upper portion 114*a'* forms a step relative to the lower portion 114*b'* of the toilet base bowl 114'. In another embodiment, the upper portion 114*a'* forms a U-shaped cavity 114*d'* therein. Concepts of the present disclosure hereinafter are explained in relation to mounting of the toilet rim 116', in the U-shaped cavity 114*d'* in the upper portion 114*a'* of the toilet base bowl 114'. Similar concepts of the present disclosure may be envisioned to be applied in relation to mounting of the toilet rim 116', on the step of the upper portion 114*a'* of the toilet base bowl 114'.

The toilet rim 116' is at least partially formed of an elastomer material and is positioned within the U-shaped cavity 114*d'* formed in the upper portion 114*a'* of the toilet base bowl 114'. The toilet rim 116' includes a tubular structure 118', a connection adapter 119', and a plurality of outlet conduits 120'.

The tubular structure 118' is formed of a soft elastomer material, such as but not limited to, thermoplastic elastomer (TPE), rubber, EVA (Elastic Plastic), foam, and the like. The tubular structure 118' is provided in form of a singular tubular structure, suitably bent to form an oval-structured unit, in particular an open-looped oval-structure unit, conforming to or corresponding to the upper portion of the toilet base bowl 114'. Although, the present disclosure is explained as the tubular structure 118' being deployed as the open-looped oval-structure unit, it may be apparent to a person having ordinary skill in the art that the tubular structure 118' can also be deployed as an open-looped square structured unit, and/or an open-looped circular structured unit, depending on a shape of the upper portion 114*a'* of the toilet base bowl 114'. The tubular structure 118' defines a first end 118*a'*, a second end 118*b'*, and a middle section 118*c'* defined therebetween. Further, the second end 118*b'* of the tubular structure 118' is closed. Furthermore, the tubular structure 118' is sequentially divided into four sections, namely a first section 118*e'*, a second section 118*f'*, a third section 118*g'*, and a fourth section 118*h'*, in the water flow direction. The first section 118*e'* includes the first end 118*a'*, and the fourth section 118*h'* includes the second end 118*b'*. An interior of the tubular structure 118' has a cross-section area that decreases continuously from the first end 118*a'* to the second end 118*b'* in the water flow direction. The interior of at least one portion of the tubular structure 118' has an elliptical cross-section area. This allows a smooth and laminar flow of water within the tubular structure 118', while flowing from the first end 118*a'* to the second end 118*b'* in the water flow direction. In particular, the cross-sectional area of the at an end of the first section 118*e'* in the water flow direction is 50% of a cross-section area at the first end 118*a'* defined by the first section 118*e'* of the tubular structure 118'. Moreover, a cross-section area at an end of the second section 118*f'* in the water flow direction is 36% of the cross-section area at the first end 118*a'* defined by the first section 118*e'* of the tubular structure 118'. Moreover, a cross-section area at an end of the third section 118*g'* in the water flow direction is 25% of the cross-section area of the first end 118*a'* defined by the first section 118*e'* of the tubular structure 118'. Furthermore, a cross-section area at the second end 118*b'* defined by the fourth section 118*h'* of the tubular structure in the water flow direction is 9.5% of the cross-section area of the first end 118*a'* defined by the first section 118*e'* of the tubular structure 118'. It may also be noted that the cross-section of the tubular structure 118' decreases continuously from the first end 118*a'* to the second end 118*b'*, in particular, the cross-section of the tubular structure 118' decreases continuously between the first section 118*e'*, the second section 118*f'*, the third section 118*g'*, and the fourth section 118*h'*. This results in positioning of the first end 118*a'* of the tubular structure 118' at a relatively higher height than the second end 118*b'* of the tubular structure 118'.

The connection adapter 119' is provided to fluidly couple the tubular structure 118' to the supply pipe 110 and is made up of a relatively hard elastomer material, such as but not limited to, thermoplastic elastomer (TPE), rubber, EVA (Elastic Plastic), foam, and the like. For such purposes, the connection adapter 119' is fluidly coupled to the first end 118*a*' of the tubular structure 118'. Further, the connection adapter 119' is also fluidly coupled to the supply pipe 110. With such arrangement, the tubular structure 118' may receive water through the connection adapter 119' at the first end 118*a*', to be flown in a water flow direction towards the second end 118*b*' through the middle section 118*c*'.

The plurality of outlet conduits 120' are configured to release water received in the tubular structure 118' to the toilet base bowl 114', for flushing. The plurality of outlet conduits 120' are relatively small conduit pipes extending from the middle section 118*c*' directed towards an interior of the toilet base bowl 114'. The plurality of outlet conduits 120' are angled at an acute angle relative to the water flow direction. As the plurality of outlet conduits 120' are angled at an acute angle, the plurality of outlet conduits 120' allow exit of water to an interior of the toilet base bowl 114', in a swirl-flow manner Such exit of water to the interior of the toilet base bowl 114' in the swirl-flow manner, requires relatively less water for flushing the faecal matter from the toilet base bowl 114'. For attachment of the toilet rim 116' to the toilet base bowl 114', the tubular structure 118' of the toilet rim 116' is attached within the U-shaped cavity 114*d*' formed within the upper portion 114*a*' of the toilet base bowl 114'. The tubular structure 118' of the toilet rim 116' is attached within the U-shaped cavity 114*d*' formed within the upper portion 114*a*' of the toilet base bowl 114', via an attachment means. The attachment means includes, but is not limited to, an adhesive attachment, a C-clip attachment, a plastic attachment, a bolt attachment, and/or any other similar attachment means. With such arrangement, the tubular structure 118' may receive water through the connection adapter 119' at the first end 118*a*' of the tubular structure 118', to be flown in a water flow direction towards the second end 118*b*', and further exit the water to the interior of the toilet base bowl 114' through the plurality of outlet conduits 120'.

Various advantages of the toilet bowl 102, as disclosed in the present disclosure, exists. For example, as the plurality of outlet conduits 120, 120' of the toilet rim 116, 116' of the toilet bowl 102 are angled at an acute angle, the plurality of outlet conduits 120, 120' allow exit of water to an interior of the toilet base bowl 114, 114', in a swirl-flow manner Such exit of water to the interior of the toilet base bowl 114, 114' in the swirl-flow manner, requires relatively less water for flushing the faecal matter from the toilet base bowl 114, 114'. Additionally, such exit of water to the interior of the toilet base bowl 114, 114' in the swirl-flow manner causes a relatively more coverage of flush area within the interior of the toilet base bowl 114, 114' and thus causes better cleaning. Another advantage of the present disclosure relates to water attachment of the tubular structure 118, 118' at the first end 118*a*, 118*a*', and the second end 118*b*, 118*b*' being closed. This enables flow of water only in one direction forming only one stream of water, instead of the T-joint. This avoids any backflow or cancellation of flow of water, and thus saves a kinetic energy of water, and consequently requires less water for flushing operations. Yet another advantage of the toilet bowl 102, as disclosed in the present disclosure, relates to the first end 118*a*, 118*a*' of the tubular structure 118, 118' been placed at a relatively higher height than the second end 118*b*, 118*b*' of the tubular structure 118, 118'. This results in a relatively increased average velocity of water exiting from the tubular structure 118, 118' of the toilet rim 116, 116' to the toilet base bowl 114, 114' and thus requires relatively less water, for flushing operations. Yet another advantage of the present disclosure relates to the continuously decreasing cross-section of the tubular structure 118, 118' between the first section 118*e*, 118*e*', the second section 118*f*, 118*f*', the third section 118*g*, 118*g*', and the fourth section 118*h*, 118*h*'. This facilitates in gradual decrease in average velocity of water flowing in the tubular structure 118, 118'. Thus, the kinetic energy of the water flowing in the tubular structure 118, 118' is conserved and adds to low requirements of water for flushing purposes. As the interior of at least one portion of the tubular structure 118, 118' has an elliptical cross-section area, it allows a smooth and laminar flow of water within the tubular structure 118, 118', while flowing from the first end 118*a*, 118*a*' to the second end 118*b*, 118*b*' in the water flow direction. Overall, the specific design, structure, and arrangement of the toilet rim 116, 116' of the toilet bowl 102, as disclosed in the present disclosure, requires relatively less water, for flushing purposes.

The present disclosure also provides a toilet arrangement 100 (e.g., a toilet). The toilet arrangement 100 comprises the toilet base bowl 114 and the toilet rim 116 according to any examples as described above.

In an embodiment, the toilet arrangement 100 includes a base (e.g., a pedestal, bowl, etc.) and the flush tank 106. The base is configured to be attached to another object such as a drainpipe, floor, or another suitable object. The base includes a bowl, a sump (e.g., a receptacle) disposed below the bowl, and a trapway fluidly connecting the bowl to a drainpipe or sewage line. The flush tank 106 may be supported by the base, such as an upper surface of a rim. The flush tank 106 may be integrally formed with the base as a single unitary body. In other embodiments, the flush tank 106 may be formed separately from the base and coupled (e.g., attached, secured, fastened, connected, etc.) to the base. The toilet arrangement 100 may further include a tank lid covering an opening and inner cavity in the tank. The toilet arrangement 100 may include a seat assembly including a seat and a seat cover rotatably coupled to the base. The toilet arrangement 100 may further include a hinge assembly.

In another embodiment, the toilet arrangement 100 may be a tankless toilet. The toilet arrangement 100 includes a base and a seat assembly coupled to the base. The base includes a bowl, a sump disposed below the bowl, and a trapway fluidly connecting the bowl to a drainpipe or sewage line. The toilet arrangement 100 includes a waterline that supplies the toilet arrangement 100 with water. The toilet arrangement 100 may further include a seat assembly including a seat and a seat cover rotatably coupled to the base. The toilets described above are provided herein as non-limiting examples of toilets that may be configured to utilize aspects of the present disclosure.

In some examples, a bidet may be included in a seat or pedestal of a toilet. In other examples, the bidet may be manufactured separately from and attached or coupled to a seat or pedestal of a toilet. The bidet includes a housing. The housing is configured to receive a flow of water through a housing inlet and dispense the flow of water from a housing outlet. The housing inlet and housing outlet may be located on opposite ends of the housing from one another, such that water may flow through the housing from the housing inlet to the housing outlet. In some examples, the housing further includes a chamber. As the housing receives the flow of water, the chamber may fill with water and provide a flow of water between the housing inlet and the housing outlet. The chamber may be configured to contain the flow of water and direct the flow of water from the housing inlet to the housing outlet. After the chamber has filled with water, the flow of water may travel along a substantially linear path between the housing inlet and the housing outlet. In some examples, one or more walls within the housing may be included to help direct a flow of water between the housing inlet and the housing outlet. The bidet may further include a housing inlet conduit configured to direct a flow of water to the housing inlet. The housing inlet conduit may be coupled to a water supply such as tank or waterline. The housing may further include a gear assembly or a portion of the gear assembly.

Figure 8:
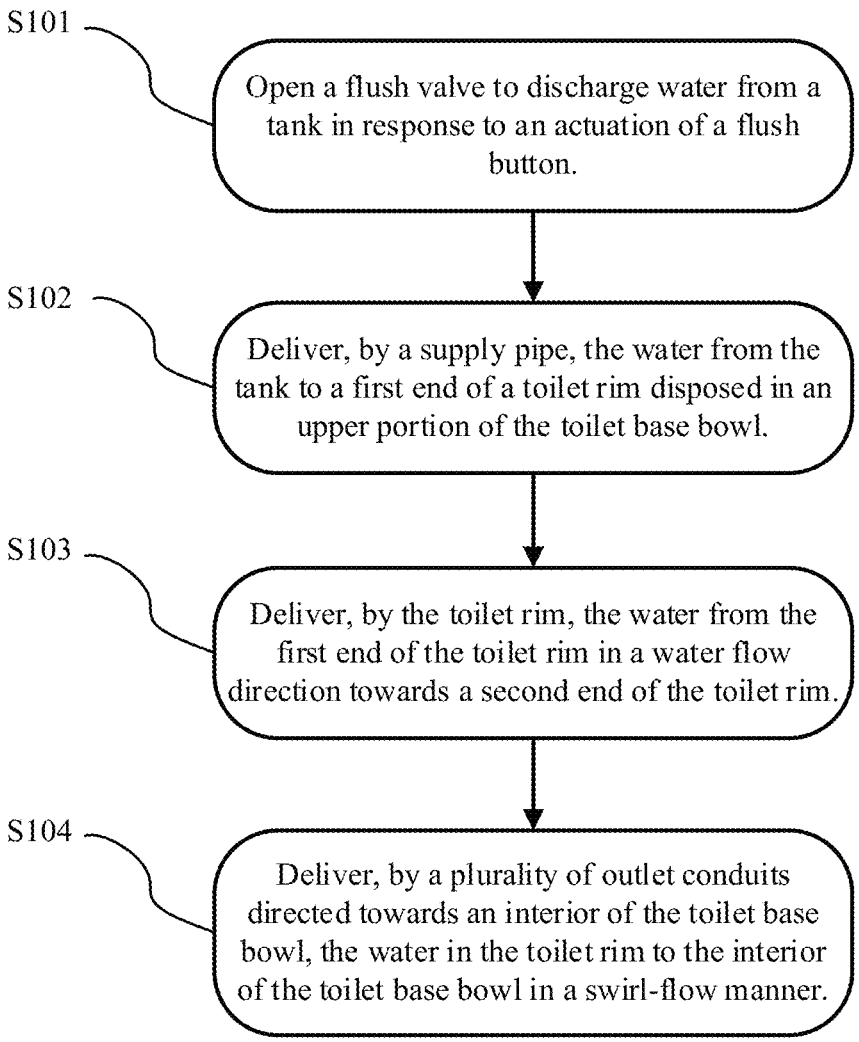
FIG. 8 is a flow chart of a method for cleaning a toilet base bowl of a toilet by using a toilet rim according to an example of the present disclosure.

FIG. 8 is a flow chart of a method for cleaning a toilet base bowl of a toilet by using a toilet rim according to an example of the present disclosure. The toilet rim used in the method may be toilet rim 116 according to any of the foregoing examples and may be configured to perform an operation, function, or the like as described in the present disclosure.

At act S101, an actuation of the flush button 112 may open the flush valve unit to discharge water from the flush tank 106. As noted above, the flush valve unit is positioned within the supply pipe 110 and is configured to allow/restrict the supply of water from the flush tank 106 of the flush arrangement 104 to the toilet bowl 102. In particular, the flush valve unit allows/restrict the supply of water from the flush tank 106 of the flush arrangement 104 to the toilet bowl 102, upon actuation/release of at least one flush button 112.

At act S102, the supply pipe 110 may deliver the water from the tank 106 to the first end 118*a* of the toilet rim 116 disposed in the upper portion 114*a* of the toilet base bowl 114. As noted above, the first end 118*a* is fluidly connected to the supply pipe 110 of the flushing arrangement 104 to receive the water from the flushing arrangement 104.

At act S103, the toilet rim 116 may deliver the water from the first end 118*a* of the toilet rim 116 in the water flow direction towards the second end 118*b* of the toilet rim 116. As noted above, the second end 118*b* is closed. With such an arrangement, the tubular structure 118 is configured to receive water through the first end 118*a*, to be flown in the water flow direction towards the second end 118*b* through the middle section 118*c*.

At act S104, the plurality of outlet conduits directed towards an interior of the toilet base bowl 114 may deliver the water in the toilet rim 116 to the interior of the toilet base bowl 114 in a swirl-flow manner. As noted above, the plurality of outlet conduits 120 are relatively small conduit pipes extending from the middle section 118*c* directed towards the interior of the toilet base bowl 114. The plurality of outlet conduits 120 are angled or directed at the acute angle relative to the water flow direction. As the plurality of outlet conduits 120 are angled at the acute angle, the plurality of outlet conduits 120 allow exit of water to the interior of the toilet base bowl 114 in the swirl-flow manner.

Although particular embodiments have been disclosed herein in detail, this is for illustrative purposes only and is not intended in any way to limit the intended scope of the present disclosure. Variations and adaptions of the system and the method as described herein do not depart from the spirit and scope of the present disclosure and should be within the expertise of a person having ordinary skill in the art.

LIST OF COMPONENTS

100—Toilet Arrangement
102—Toilet Bowl
104—Flushing Arrangement 106—Flush Tank
110—Supply Pipe
112—Flush Button
114, 114'—Toilet Base Bowl
116, 116'—Toilet Rim
114*a*, 114*a'*—Upper Portion of 114
114*b*, 114*b'*—Lower Portion of 114
116—Toilet Rim
118, 118'—Tubular Structure
118*a*, 118*b*—First End, Second End of 118
118*a'*, 118*b'*—First End, Second End of 118'
118*c*—Middle Section of 118
118*c'*—Middle Section of 118'
119—Connection Adapter
120—Outlet Conduits

We claim:

1. A toilet bowl of a toilet, the toilet bowl comprising:
a toilet base bowl comprising an upper portion; and
a toilet rim disposed in the upper portion of the toilet base bowl, the toilet rim comprising:
a tubular structure comprising a first end configured to receive water, a second end, and a middle section disposed between the first end and the second end, wherein the water is configured to flow in a water flow direction towards the second end, and the second end is closed, wherein an interior of the tubular structure has a cross-section area that decreases continuously from the first end to the second end in the water flow direction; and
a plurality of outlet conduits extending from the middle section directed towards an interior of the toilet base bowl, the plurality of outlet conduits being directed at an acute angle relative to the water flow direction, such that plurality of outlet conduits allow the water to enter the interior of the toilet base bowl in a swirl-flow manner.

2. The toilet bowl according to claim 1, wherein the tubular structure comprises a first section including the first end, a second section, a third section, and a fourth section including the second end.

3. The toilet bowl according to claim 2, wherein a cross-section area at an end of the first section in the water flow direction is 50% of a cross-section area at the first end included in the first section of the tubular structure.

4. The toilet bowl according to claim 2, wherein a cross-section area at an end of the second section in the water flow direction is 36% of the cross-section area at the first end included in the first section of the tubular structure.

5. The toilet bowl according to claim 2, wherein a cross-section area at an end of the third section in the water flow direction is 25% of the cross-section area at the first end included in the first section of the tubular structure.

6. The toilet bowl according to claim 2, wherein a cross-section area at the second end included in the fourth section of the tubular structure in the water flow direction is 9.5% of the cross-section area at the first end included in the first section of the tubular structure.

7. The toilet bowl according to claim 1, wherein the first end of the tubular structure of the toilet rim is configured to be fluidly connected to a flushing arrangement to receive the water from the flushing arrangement.

8. The toilet bowl according to claim 1, wherein the tubular structure of the toile t rim forms an oval-structured unit configured to be disposed in an inner periphery of the upper portion of the toilet base bowl.

9. The toilet bowl according to claim 1, wherein the first end of the tubular structure is disposed at a relatively higher level than the second end of the tubular structure.

10. The toilet bowl according to claim 1, wherein an interior of at least one portion of the tubular structure has an elliptical cross-section area.

11. A toilet rim for a toilet bowl of a toilet, the toilet rim comprising:

a tubular structure comprising a first end, a second end, and a middle section disposed between the first end and the second end;

a connection adapter fluidly coupled to the first end of the tubular structure, wherein the tubular structure is configured to receive water through the connection adapter, the water is configured to flow in a water flow direction towards the second end, and the second end is closed, wherein an interior of the tubular structure has a cross-section area that decreases continuously from the first end to the second end in the water flow direction; and a plurality of outlet conduits extending from the middle section directed towards an interior of a toilet base bowl, the plurality of outlet conduits being directed at an acute angle relative to the water flow direction, such that plurality of outlet conduits allow the water to enter the interior of the toilet base bowl in a swirl-flow manner.

12. The toilet rim according to claim 11, wherein the tubular structure of the toilet rim is configured to be attached to a step formed on an upper portion of the toilet base bowl via an attachment means.

13. The toilet rim according to claim 11, wherein the tubular structure comprises a first section including the first end, a second section, a third section, and a fourth section including the second end.

14. The toilet rim according to claim 11, wherein the cross-section area at an end of the first section in the water flow direction is 50% of the cross-section area at the first end included in the first section of the tubular structure.

15. The toilet rim according to claim 11, wherein the cross-section area at an end of the second section in the water flow direction is 36% of the cross-section area at the first end included in the first section of the tubular structure.

16. The toilet rim according to claim 11, wherein the cross-section area at an end of the third section in the water flow direction is 25% of the cross-section area at the first end included in the first section of the tubular structure.

17. The toilet rim according to claim 11, wherein the cross-section area at the second end included in the fourth section of the tubular structure in the water flow direction is 9.5% of the cross-section area at the first end included in the first section of the tubular structure.

18. A method for cleaning a toilet base bowl of a toilet by using a toilet rim, the method comprising:

opening a flush valve to discharge water from a tank in response to an actuation of a flush button;

delivering, by a supply pipe, the water from the tank to a first end of a toilet rim disposed in an upper portion of the toilet base bowl;

delivering, by the toilet rim, the water from the first end of the toilet rim in a water flow direction towards a second end of the toilet rim, wherein an interior of the tubular structure has a cross-section area that decreases continuously from the first end to the second end in the water flow direction; and delivering, by a plurality of outlet conduits directed towards an interior of the toilet base bowl, the water in the toilet rim to the interior of the toilet base bowl in a swirl-flow manner, wherein the plurality of outlet conduits extend from a middle section of the toilet rim and directed at an acute angle relative to the water flow direction, wherein the middle section of the toilet rim is disposed between the first end of the toilet rim and the second end of the toilet rim, and wherein the second end of the toilet rim is closed.

* * * * *